United States Patent [19]

Coppens

[11] 3,944,114

[45] Mar. 16, 1976

[54] SCREW THREADED PLASTIC PLUG

[75] Inventor: Matheus Johannes Martinus Coppens, Kalmthout, Belgium

[73] Assignee: Koninklijke Emballage Industrie Van Leer B.V., Amstelveen, Netherlands

[22] Filed: Mar. 14, 1975

[21] Appl. No.: 558,323

[30] Foreign Application Priority Data

Mar. 20, 1974 Netherlands ..... 7403762

[52] U.S. Cl. ..... 220/288

[51] Int. Cl.[2] ..... B65D 41/04; B65D 41/34

[58] Field of Search ..... 220/288; 215/214; 285/201; 150/5

[56] References Cited

UNITED STATES PATENTS

| | | | |
|---|---|---|---|
| 2,962,185 | 11/1960 | Starr et al. | 220/288 X |
| 3,140,007 | 7/1964 | Nettleship | 220/288 X |

*Primary Examiner*—George T. Hall

*Attorney, Agent, or Firm*—Harness, Dickey & Pierce

[57] ABSTRACT

A plug of plastic or other soft material to be screwed into a metal neck, with means for preventing the possibility of screwing in the plug obliquely. The means comprises a cone-shaped bevel around the first thread of the plug, the top angle of the bevelling cone corresponding to the top angle of the reamer used to ream the entry of the neck screw thread.

8 Claims, 2 Drawing Figures

SCREW THREADED PLASTIC PLUG

The invention relates to a plug of plastic or another rather soft material, provided with external screw thread and adapted to be screwed in a metal neck provided with internal screw thread, especially in a closure of a vessel.

Such a plug is in practice commonly known and is generally manufactured by molding from plastic.

At screwing-in such a rather soft plug in a hard metal neck there exists the chance that the plug is screwed-in obliquely in the neck. When then the plug is fastened manually or mechanically, there exists the danger that the plug is screwed-in obliquely and that the hard screw thread of the neck makes a new screw thread in the rather soft plug, by which the plug will be further unusable.

The invention aims to remove this disadvantage and this is obtained in that the first thread of the screw thread on the plug is bevelled over 360° by cone-shaping the lower edge of the plug, the top angle of the bevelling cone corresponding to the top angle of the reamer, with which the entry of the screw thread in the neck has been reamed.

Thus the bevelled edge is extending over the whole circumference of the lower edge of the plug and is concerning the angle adapted to the angle of the entry of the screw thread in the neck. The angle of the entry is determined by the top angle of the reamer, with which the screw thread in the neck is reamed. This measure gives a solution of the problem of screwing-in obliquely, because in this way the centre of the plug will tend to coincide with the axis of the neck and because over a great part of the circumference of the plug the first thread is located at such a small diameter, that when the next thread comes into contact with the cylindrical part of the neck, the first thread of the screw thread cannot be located below the entry of the thread of the neck.

However, this bevelled edge is only effective, when the thread profile has a triangle form. However, this is not always the case.

At a plug with external screw thread in the form of a truncated triangle or a triangle with rounded top angle this cone-shaped bevelled edge does not give a screw top diameter increasing equally and again there exists a danger of screwing-in obliquely.

For this reason such a plug is carried out in such a way that about 90° before and 90° after the point where the bevelling cone is intersecting the foot of the first thread on the screw thread on the plug, second and third cone-shaped bevelled edges start, the top angles of the second and third bevelling cones being greater than the top angle of first bevelling cone and the first bevelling cone is intersecting the bottom of the plug at a larger diameter than the second and third bevelling cone.

In this way practically each chance of screwing-in obliquely is avoided. On the tops of the thread a smooth line is formed.

The invention will now be explained for an embodiment referring to a drawing, in which.

The plug according to the invention is moulded from plastic with screw thread of triangle form and rounded top angle.

The plug comprises an upper flange 1, with which not-shown fastening means can engage and the lower edge of which is sealing on the upper edge of a not-shown metal neck. This neck can form the cylindrical part of the closure of the vessel.

Further the plug comprises a cylindrical part 2 which forms one part with the flange 1 and which is provided with external screw thread 3. This cylindrical part 2 can be solid or may consist of a thick cylindrical wall, at the lower side closed by a bottom.

Figure 1:
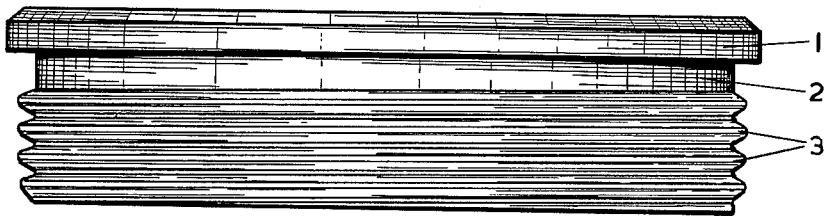
FIG. 1 is a side view of the plug according to the invention.
Figure 2:
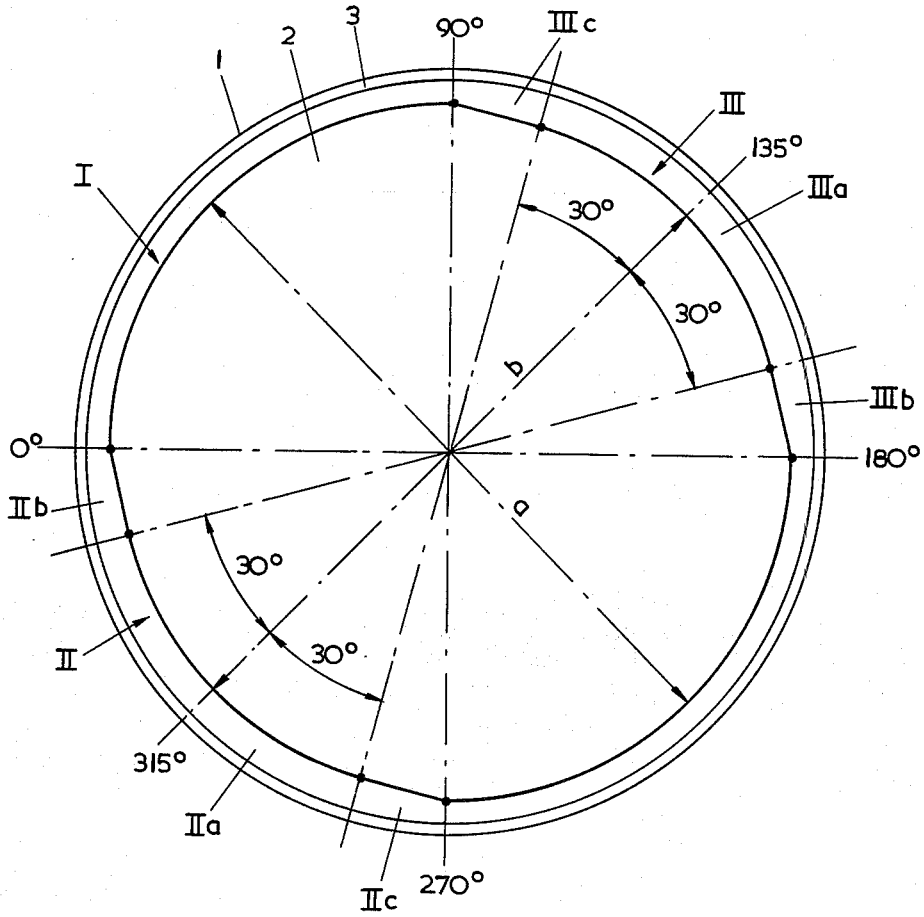
FIG. 2 is a bottom view of the plug according to FIG. 1.

In FIG. 2 the different bevelled edges according to the invention are shown.

The first bevelled edge extends over 360° and is indicated with I. This bevelled edge I intersects the bottom of the plug along a circle, the diameter of which is indicated with a.

The second bevelled edge is indicated with II and extends over about 90°, in FIG. 2 the quadrant extending from 270° – 0°.

The bevelled edge II consists of three parts. The centre part II*a* is formed by a second bevelling cone and extends over about 30° on both sides of the radius indicated with 315°. Two tangential exits II*b* and II*c* are connected with this centre part II*a*, which tangential exits thus extend over about 15° and form the transition to the bevelled edge I at the diameter *a*. The bevelling angles over the parts II*a*, II*b* and II*c* are the same.

The bevelling cone for forming the bevelling edge II*a* intersects the bottom of the plug on a circle, the diameter of which is indicated with *b*. The diameter *b* is smaller than the diameter *a* for the bevelled edge I.

The third bevelled edge is indicated with III and extends also over about 90°, namely over the quadrant extending from 90° – 180°. Also the third bevelled edge consists of the parts III*a*, III*b* and III*c*, corresponding to the second bevelled edge II.

For clearity the transition points between the different bevelled edges are indicated in FIG. 2 with thick dots.

Preferably the bevelled edge I is made with a cone with a top angle of 90°. This means thus that the bevelled edge I is at an angle with the horizontal line of 45°.

The bevelled edge II is made with a cone with a top angle of 125°. The bevelled edge II is thus with the horizontal line at an angle of 27°30′.

The bevelled edge III is made with a cone with a top angle of 145°. The bevelled edge III is thus with the horizontal line at an angle of 17°30′.

The bevelling cone forming the bevelled edge I intersects the foot of the thread 3 on the radius 0°. The bevelled edge II starts at radius 270°, thus 90° before radius 0° and the bevelled edge III starts at radius 90° thus 90° after radius 0°.

By the differences in bevelling angles between the bevelled edges II and III each chance on screwing-in obliquely is avoided, because in this way the first thread of the plug can never be located below the thread entry of the neck.

The bevelled edge III removes namely a part of the flank of the first thread, when the bevelling cone of the bevelled edge III intersects the bottom of the plug at a certain diameter. In order to provide that the bevelled edge II also removes a part of the flank of the first thread, the bevelling cone of the bevelled edge II intersecting the bottom of the plug on a circle with diameter

*b* as well as the bevelling cone of the bevelled edge III must have a smaller top angle than the bevelling cone of the bevelled edge III.

In the embodiment shown and described here above the cones with which the bevelled edges II and III are made, have a different top angle and intersect both the bottom of the plug on a circle with a diameter *b*. However, it is also possible to give the top angles of both cones the same value, but then to let intersect the cone the bottom on circles with different diameters. In that case the cone of the bevelled edge III must intersect the bottom on a circle with a greater diameter than the cone of the bevelled edge II. This variant is not indicated in a drawing.

The invention can also be applied to plugs of other material than plastic, for instance zinc.

I claim:

1. Plug of plastic or another rather soft material provided with external screw thread and adapted to be screwed in a metal neck provided with internal screw thread, especially in a closure of a vessel, characterized in that the first thread of the screw thread on the plug is bevelled over 360° by cone-shaping the lower edge of the plug, the top angle of the bevelling cone corresponding to the top angle of the reamer, with which the entry of the screw thread in the neck has been reamed.

2. Plug according to claim 1 with external screw thread in the form of a truncated triangle or a triangle with a rounded top angle, characterized in that about 90° before and 90° after the point where the bevelling cone is intersecting the foot of the first thread of the screw thread on the plug, second and third cone-shaped bevelled edges start the top angles of the second and third bevelling cones being greater than the top angle of the first bevelling cone and the first bevelling cone is intersecting the bottom of the plug at a larger diameter than the second and third bevelling cone.

3. Plug according to claim 1, characterized in that the second and the third bevelled edges are extending over about 90° in the circumferential direction of the plug.

4. Plug according to claim 3, characterized in that the second as well as the third bevelled edges are formed over about 60° by bevelling cones and at both ends have the form of a tangential exit over about 15° with the same angle in order to meet with the starting points and end points of the first bevelling cones.

5. Plug according to claim 2 characterized in that the top angle of the second bevelling cone differs from the top angle of the third bevelling cone.

6. Plug according to claim 2, characterized in that the top angle of the first bevelling cone is about 90°, the top angle of the second bevelling cone is about 125° and the top angle of the third bevelling cone is about 145°.

7. Plug according to claim 2, characterized in that the top angle of the second and third bevelling cones are the same and in that the bevelling cones intersect the bottom of the plug on circles with different diameters.

8. Plug according to claim 7, characterized in that the bevelling cone of the third bevelling edge intersects the bottom of the plug on a circle with a greater diameter than the bevelling cone of the second bevelling edge.

* * * * *